US007659237B2

(12) United States Patent
Baldridge et al.

(10) Patent No.: US 7,659,237 B2
(45) Date of Patent: Feb. 9, 2010

(54) INCREASING SURFACE-ACTIVE PROPERTIES OF SURFACTANTS

(75) Inventors: John W. Baldridge, Newport Beach, CA (US); Carl W. Podella, Irvine, CA (US)

(73) Assignee: Advanced BioCatalytics Corp., Irvine, CA (US)

( * ) Notice: Subject to any disclaimer, the term of this patent is extended or adjusted under 35 U.S.C. 154(b) by 134 days.

(21) Appl. No.: 10/837,312

(22) Filed: Apr. 29, 2004

(65) Prior Publication Data

US 2005/0245414 A1 Nov. 3, 2005

(51) Int. Cl.
*C11D 9/40* (2006.01)
*C11D 1/32* (2006.01)

(52) U.S. Cl. ..... 510/280; 510/370; 510/405; 510/537; 8/137

(58) Field of Classification Search ..... 435/220–2; 510/392, 393, 370, 405, 537, 280; 8/339, 8/340, 342, 137
See application file for complete search history.

(56) References Cited

U.S. PATENT DOCUMENTS

| | | | | |
|---|---|---|---|---|
| 2,320,479 | A | 6/1943 | Sperti | |
| 3,404,068 | A | 10/1968 | Battistoni | |
| 3,635,797 | A * | 1/1972 | Battistoni et al. | 210/632 |
| 5,238,925 | A | 8/1993 | Bentley | |
| 5,356,874 | A | 10/1994 | Bentley | |
| 5,514,591 | A | 5/1996 | Levin | |
| 5,714,169 | A | 2/1998 | Levin | |
| 5,820,758 | A * | 10/1998 | Dale et al. | 210/601 |
| 5,849,566 | A | 12/1998 | Dale et al. | |
| 5,885,950 | A * | 3/1999 | Dale et al. | 510/194 |
| 5,897,928 | A | 4/1999 | Sanders et al. | |
| 6,033,875 | A | 3/2000 | Bussineau et al. | |
| 6,682,924 | B1 | 1/2004 | Sierkstra et al. | |
| 7,348,168 | B2 * | 3/2008 | Wu et al. | 435/161 |
| 2008/0167445 | A1 * | 7/2008 | Podella et al. | 530/350 |

FOREIGN PATENT DOCUMENTS

WO WO 97/07202 * 2/1997

OTHER PUBLICATIONS

Donna J. Schlemm, et al. "Medicinal Yeast Extracts" Cell Stress and Chaperones (Feb. 1999, 4 (3), pp. 171-176).
J. Peter Bentley, Ph.D., et al. "Peptides From Live Yeast Cell Derivative Stimulate Wound Healing" Arch Surg (May 1999, vol. 124, pp. 641-646).
Euan W. Low, et al. "Reducing Production of Excess Biomass During Wastewater Treatment" Wat. Res., (vol. 33, No. 5, pp. 1119-1132, Jul. 1998.
Euan W. Low, et al. "The Use of Chemical Uncouplers for Reducing Biomass Production During Biodegradation" Wat. Sci. Tech. (vol. 37, No. 4-5, pp. 399-402, 1998).
James B. Russell, et al. "Energetics of Bacterial Growth: Balance of Anabolic and Catabolic Reactions" Microbiological Reviews (Mar. 1995, pp. 48-62).

* cited by examiner

*Primary Examiner*—Lorna M Douyon
*Assistant Examiner*—Amina Khan
(74) *Attorney, Agent, or Firm*—Sam K. Tahmassebi; TechLaw, LLP

(57) ABSTRACT

Surfactant-containing compositions are described which include a protein component that has the effect of improving the surface-active properties of the surfactants contained in the compositions. The surfactant-containing compositions having the protein component demonstrate significantly lower critical micelle concentrations (CMC) than do comparable compositions having no protein component. In addition, the surfactant-containing compositions having the protein component have the effect of converting greasy waste contaminants to surface active materials.

21 Claims, No Drawings

INCREASING SURFACE-ACTIVE PROPERTIES OF SURFACTANTS

FIELD OF THE INVENTION

This invention relates to surfactant mixtures with improved surface-active properties, and methods of making and using the same. More particularly, this invention relates to surfactant compositions containing a protein component that has the effect of improving the surface-active properties of the surfactants contained in the compositions.

BACKGROUND OF THE INVENTION

Surfactants (also called surface active agents or wetting agents) are organic chemicals that reduce surface tension in water and other liquids. There are hundreds of compounds that can be used as surfactants. These compounds are usually classified by their ionic behavior in solutions: anionic, cationic, non-ionic or amphoteric (zwitterionic). Each surfactant class has its own specific physical, chemical, and performance properties.

Surfactants are compounds composed of both hydrophilic and hydrophobic or lipophobic groups. In view of their dual hydrophilic and hydrophobic nature, surfactants tend to concentrate at the interfaces of aqueous mixtures; the hydrophilic part of the surfactant orients itself towards the aqueous phase and the hydrophobic parts orients itself away from the aqueous phase into the second phase.

The hydrophobic part of a surfactant molecule is generally derived from a hydrocarbon containing 8 to 20 carbon atoms (e.g. fatty acids, paraffins, olefins, alkylbenzenes). The hydrophilic portion may either ionize in aqueous solutions (cationic, anionic) or remain un-ionized (non-ionic). Surfactants and surfactant mixtures may also be amphoteric or zwitterionic.

Surfactants are known for their use in personal care products (e.g., soaps, specialty soaps, liquid hand soaps, shampoos, conditioners, shower gels, dermatology and acne care products), household products (e.g., dry and liquid laundry detergents, dish soaps, dishwasher detergents, toilet bowl cleaners, upholstery cleaners, fabric softeners), hard surface cleaners (floor cleaners, metal cleaners, automobile and other vehicle cleaners), pet care products (e.g., shampoos), and cleaning products in general. Other uses are in industrial applications in lubricants, emulsion polymerisation, textile processing, mining flocculates, petroleum recovery, wastewater treatment and many other products and processes. Surfactants are also used as dispersants after oil spills.

SUMMARY OF THE INVENTION

The present invention relates to the use of a protein component that is used as an additive to surfactant-containing compositions, particularly detergents, in order to improve the surface-active properties of the surfactants. In this way, the surfactant-containing compositions may be made more effective, or they may be formulated to have a lower concentration of surfactants than would otherwise be needed to achieve a desired level of surface-activity.

The protein component preferably comprises a variety of proteins produced by an aerobic yeast fermentation process. The aerobic yeast fermentation process is conducted within a reactor having aeration and agitation mechanisms, such as aeration tubes and/or mechanical agitators. The starting materials (liquid growth medium, yeast, sugars, additives) are added to the fermentation reactor and the fermentation is conducted as a batch process. After fermentation, the fermentation product may be subjected to additional procedures intended to increase the yield of proteins produced from the process. Examples of these additional procedures include heat shock of the fermentation product, physical and/or chemical disruption of the yeast cells to release additional polypeptides, lysing of the yeast cells, or other procedures described herein and/or known to those of skill in the art. The yeast cells are removed by centrifugation or filtration to produce a supernatant containing the protein component.

The protein component produced by the above fermentation process comprises a large number of proteins having a variety of molecular weights. Although the entire composition of proteins may be useful for improving surface-active properties of surfactants, the inventors have found that the proteins having molecular weights in the range of about 100 to about 450,000, and preferably from about 500 to about 50,000 daltons (as indicated by results of polyacrylamide gel electrophoresis), are sufficient to achieve desirable results.

Although the protein component of the present invention is preferably obtained by the foregoing fermentation process, the component may also be obtained by alternative methods, including direct synthesis or isolation of the proteins from other naturally occurring sources.

The protein component is preferably added to compositions containing surfactants in order to improve the surface-active properties of the surfactants and, in fact, to change the nature of the surface-active properties of the surfactants. For example, the protein component may advantageously be used as an additive to detergent compositions, which comprise a detersive surfactant system and adjunct detergent ingredients. Several (non-limiting) embodiments of detergent compositions include personal care products (e.g., soaps, specialty soaps, liquid hand soaps, shampoos, conditioners, shower gels, dermatology and acne care products), household products (e.g., dry and liquid laundry detergents, dish soaps, dishwasher detergents, toilet bowl cleaners, upholstery cleaners, fabric softeners), hard surface cleaners (floor cleaners, metal cleaners, automobile and other vehicle cleaners), pet care products (e.g., shampoos), and cleaning products in general. As will be appreciated by those of ordinary skill in the art, the foregoing list of embodiments is not intended to be exclusive, as the advantages obtained by the use of the protein mixture described herein may be applied to any detergent composition or other surfactant-containing composition.

The addition of the protein mixture of the present invention to a surfactant-containing composition has the effect of improving, increasing, and enhancing the surface-active properties of the surfactants contained in the composition. This effect has particular advantages in applications in which surface-active properties of surfactants in compositions are desired, including the detergent compositions discussed herein.

DETAILED DESCRIPTION OF THE PREFERRED EMBODIMENTS

The compositions of the present invention include a protein component used in combination with a surfactant-containing composition—for example, a detergent—to improve, increase, and enhance the surface-active properties of the surfactants contained in the composition. Thus, the methods of the present invention includes a method for improving the surface-active properties of surfactants contained in a composition by incorporating a protein component within the composition.

Protein Component

As used herein, the term "protein component" refers to a mixture of proteins that includes a number of proteins having a molecular weight of between about 100 and about 450,000 daltons, and most preferably between about 500 and about 50,000 daltons, and which, when combined with one or more surfactants, enhances the surface-active properties of the surfactants.

In a first example, the protein component comprises the supernatant recovered from an aerobic yeast fermentation process. Yeast fermentation processes are generally known to those of skill in the art, and are described, for example, in the chapter entitled "Baker's Yeast Production" in Nagodawithana T. W. and Reed G., Nutritional Requirements of Commercially Important Microorganisms, Esteekay Associates, Milwaukee, Wis., pp 90-112 (1998), which is hereby incorporated by reference. Briefly, the aerobic yeast fermentation process is conducted within a reactor having aeration and agitation mechanisms, such as aeration tubes and/or mechanical agitators. The starting materials (e.g., liquid growth medium, yeast, a sugar or other nutrient source such as molasses, corn syrup, or soy beans, diastatic malt, and other additives) are added to the fermentation reactor and the fermentation is conducted as a batch process.

After fermentation, the fermentation product may be subjected to additional procedures intended to increase the yield of the protein component produced from the process. Several examples of post-fermentation procedures are described in more detail below. Other processes for increasing yield of protein component from the fermentation process may be recognized by those of ordinary skill in the art.

*Saccharomyces cerevisiae* is a preferred yeast starting material, although several other yeast strains may be useful to produce yeast ferment materials used in the compositions and methods described herein. Additional yeast strains that may be used instead of or in addition to *Saccharomyces cerevisiae* include *Kluyveromyces marxianus, Kluyveromyces lactis, Candida utilis* (*Torula* yeast), *Zygosaccharomyces, Pichia, Hansanula*, and others known to those skilled in the art.

In the first embodiment, *saccharomyces cerevisiae* is grown under aerobic conditions familiar to those skilled in the art, using a sugar, preferably molasses or corn syrup, soy beans, or some other alternative material (generally known to one of skill in the art) as the primary nutrient source. Additional nutrients may include, but are not limited to, diastatic malt, diammonium phosphate, magnesium sulfate, ammonium sulfate zinc sulfate, and ammonia. The yeast is preferably propagated under continuous aeration and agitation between 30 degrees to 35 degrees C. and at a pH of 4.0 to 6.0. The process takes between 10 and 25 hours and ends when the fermentation broth contains between 4 and 8% dry yeast solids, (alternative fermentation procedures may yield up to 15-16% yeast solids), which are then subjected to low food-to-mass stress conditions for 2 to 24 hours. Afterward, the yeast fermentation product is centrifuged to remove the cells, cell walls, and cell fragments. It is worth noting that the yeast cells, cell walls, and cell fragments will also contain a number of useful proteins suitable for inclusion in the protein component described herein.

In an alternative embodiment, the yeast fermentation process is allowed to proceed until the desired level of yeast has been produced. Prior to centrifugation, the yeast in the fermentation product is subjected to heat-stress conditions by increasing the heat to between 40 and 60 degrees C., for 2 to 24 hours, followed by cooling to less than 25 degrees C. The yeast fermentation product is then centrifuged to remove the yeast cell debris and the supernatant, which contains the protein component, is recovered.

In a further alternative embodiment, the fermentation process is allowed to proceed until the desired level of yeast has been produced. Prior to centrifugation, the yeast in the fermentation product is subjected to physical disruption of the yeast cell walls through the use of a French Press, ball mill, high-pressure homogenization, or other mechanical or chemical means familiar to those skilled in the art, to aid the release of intracellular, polypeptides and other intracellular materials. It is preferable to conduct the cell disruption process following a heat shock, pH shock, or autolysis stage. The fermentation product is then centrifuged to remove the yeast cell debris and the supernatant is recovered.

In a still further alternative embodiment, the fermentation process is allowed to proceed until the desired level of yeast has been produced. Following the fermentation process, the yeast cells are separated out by centrifugation. The yeast cells are then partially lysed by adding 2.5% to 10% of a surfactant to the separated yeast cell suspension (10%-20% solids). In order to diminish the protease activity in the yeast cells, 1 mM EDTA is added to the mixture. The cell suspension and surfactants are gently agitated at a temperature of about 25° to about 35° C. for approximately one hour to cause partial lysis of the yeast cells. Cell lysis leads to an increased release of intracellular proteins and other intracellular materials. After the partial lysis, the partially lysed cell suspension is blended back into the ferment and cellular solids are again removed by centrifugation. The supernatant, containing the protein component, is then recovered.

In a still further alternative embodiment, fresh live *Saccharomyces cerevisiae* is added to a jacketed reaction vessel containing methanol-denatured alcohol. The mixture is gently agitated and heated for two hours at 60 degrees C. The hot slurry is filtered and the filtrate is treated with charcoal and stirred for 1 hour at ambient temperature, and filtered. The alcohol is removed under vacuum and the filtrate is further concentrated to yield an aqueous solution containing the protein component.

In a still further alternative embodiment, the protein component is further refined so as to isolate the proteins having a molecular weight of between about 100 and about 450,000, and preferably between about 500 and about 50,000 daltons, utilizing Anion Exchange Chromatography of the fermentation supernatant, followed by Molecular Sieve Chromatography. The refined protein component is then utilized in the compositions and methods described herein.

In a still further alternative embodiment, preservatives and stabilizers are added to the protein component compositions and the pH is adjusted to between 3.8 and 4.8 to provide long-term stability to the compositions.

The foregoing descriptions provide examples of a protein component suitable for use in the compositions and methods described herein. These examples are not exclusive. For example, those of skill in the art will recognize that the protein component may be obtained by isolating suitable proteins from an alternative protein source, by synthesis of proteins, or by other suitable methods. The foregoing description is not intended to limit the term "protein component" only to those examples included herein.

Additional details concerning the fermentation processes and other aspects of the protein component are described in U.S. patent application Ser. No. 10/799,529, filed Mar. 11, 2004, entitled "Altering Metabolism in Biological Processes," which is assigned to the assignee of the present application. Still further details concerning these processes and materials are described in U.S. patent application Ser. No.

09/948,457, filed Sep. 7, 2001, entitled "Biofilm Reduction in Crossflow Filtration Systems," which is also assigned to the assignee of the present application. Each of these United States patent applications is hereby incorporated by reference herein in its entirety.

Surfactants

The detergent compositions described herein include one or more surfactants at a wide range of concentration levels. Some examples of surfactants that are suitable for use in the detergent compositions described herein include the following:

Anionic: Sodium linear alkylbenzene sulphonate (LABS); sodium lauryl sulphate; sodium lauryl ether sulphates; petroleum sulphonates; linosulphonates; naphthalene sulphonates, branched alkylbenzene sulphonates; linear alkylbenzene sulphonates; alcohol sulphates.

Cationic: Stearalkonium chloride; benzalkonium chloride; quaternary ammonium compounds; amine compounds.

Non-ionic: Dodecyl dimethylamine oxide; coco diethanolamide alcohol ethoxylates; linear primary alcohol polyethoxylate; alkylphenol ethoxylates; alcohol ethoxylates; EO/PO polyol block polymers; polyethylene glycol esters; fatty acid alkanolamides.

Amphoteric: Cocoamphocarboxyglycinate; cocamidopropylbetaine; betaines; imidazolines.

In addition to those listed above, suitable nonionic surfactants include alkanolamides, amine oxides, block polymers, ethoxylated primary and secondary alcohols, ethoxylated alkylphenols, ethoxylated fatty esters, sorbitan derivatives, glycerol esters, propoxylated and ethoxylated fatty acids, alcohols, and alkyl phenols, alkyl glucoside glycol esters, polymeric polysaccharides, sulfates and sulfonates of ethoxylated alkylphenols, and polymeric surfactants. Suitable anionic surfactants include ethoxylated amines and/or amides, sulfosuccinates and derivatives, sulfates of ethoxylated alcohols, sulfates of alcohols, sulfonates and sulfonic acid derivatives, phosphate esters, and polymeric surfactants. Suitable amphoteric surfactants include betaine derivatives. Suitable cationic surfactants include amine surfactants. Those skilled in the art will recognize that other and further surfactants are potentially useful in the compositions depending on the particular detergent application.

Preferred anionic surfactants used in some detergent compositions include CalFoam™ ES 603, a sodium alcohol ether sulfate surfactant manufactured by Pilot Chemicals Co., and Steol™ CS 460, a sodium salt of an alkyl ether sulfate manufactured by Stepan Company. Preferred nonionic surfactants include Neodol™ 25-7 or Neodol™ 25-9, which are C12-C15 linear primary alcohol ethoxylates manufactured by Shell Chemical Co., and Genapol™ 26 L-60, which is a C12-C16 natural linear alcohol ethoxylated to 60E C cloud point (approx. 7.3 mol), manufactured by Hoechst Celanese Corp.

Several of the known surfactants are non-petroleum based. For example, several surfactants are derived from naturally occurring sources, such as vegetable sources (coconuts, palm, castor beans, etc.). These naturally derived surfactants may offer additional benefits such as biodegradability.

It should be understood that these surfactants and the surfactant classes described above are identified only as preferred materials and that this list is neither exclusive nor limiting of the compositions and methods described herein.

Detergent Compositions

The detergent compositions described herein generally comprise a detersive surfactant system and adjunct detergent ingredients. As those of skill in the art will recognize, the formulation of a given detergent composition will depend upon its intended use. Examples of such uses include personal care products (e.g., soaps, specialty soaps, liquid hand soaps, shampoos, conditioners, shower gels, dermatology and acne care products), household products (e.g., dry and liquid laundry detergents, dish soaps, dishwasher detergents, toilet bowl cleaners, upholstery cleaners, fabric softeners), hard surface cleaners (floor cleaners, metal cleaners, automobile and other vehicle cleaners), pet care products (e.g., shampoos), and cleaning products in general.

The detersive surfactant system may include any one or combination of the surfactant classes and individual surfactants described in the previous section and elsewhere herein, or other surfactant classes and individual surfactants known to those of skill in the art. For example, a typical liquid laundry detergent will include a combination of anionic and nonionic surfactants as the detersive surfactant system. Nonionic surfactants generally give good detergency on oily soil, whereas anionic surfactants generally give good detergency on particulate soils and contribute to formulation stability.

The adjunct detergent ingredients may include any of a range of additives that are advantageous for obtaining a desired beneficial property. For example, a typical liquid laundry detergent will include neutralizers such as monoethanolamine (MEA), diethanolamine (DEA), or triethanolamine (TEA); hydrotropic agents such as ethanol; enzyme stabilizers such as propylene glycol and/or borax; and other additives. Detergent compositions are generally known to those of skill in the art. As used herein, the term "conventional detergent" refers to detergent compositions currently available either commercially or by way of formulations available from the literature. Examples of "conventional detergents" include "conventional liquid laundry detergents," "conventional hand soaps," and others of the "conventional" detergents described herein.

Effect on Critical Micelle Concentration

A number of experiments were performed in which it was observed that the combination of the protein component with a surfactant-containing composition caused a downward shift in the critical micelle concentration (CMC) relative to that of the surfactant-containing composition without the protein component. CMC is the characteristic concentration of surface active agents (surfactants) in solution above which the appearance and development of micelles brings about sudden variation in the relation between the concentration and certain physico-chemical properties of the solution (such as the surface tension). Above the CMC the concentration of singly dispersed surfactant molecules is virtually constant and the surfactant is at essentially its optimum of activity for many applications.

The table below shows the results of CMC measurements on a sample containing surfactant alone (Sample A), and two samples containing surfactant and a protein component (Samples B and C). All tests were conducted in duplicate, by standard surface tension as a function of concentration experimentation using a Kruss Processor Tensiometer K12 with an attached automated dosing accessory. For each test a high concentration stock solution was incrementally dosed into pure distilled water, whilst measuring surface tension at each successive concentration.

Critical Micelle Concentration Values for Samples in Pure Distilled Water (on a ppm of sample basis)

| Sample | Test # | CMC (ppm) |
|---|---|---|
| Sample A (Surfactant without protein component) | Test 1 | 443 |
| | Test 2 | 440 |
| | Average | 442 |
| Sample B (Surfactant with protein component) | Test 1 | 74.6 |
| | Test 2 | 75.3 |
| | Average | 75.0 |
| Sample C (Surfactant with protein component) | Test 1 | 59.8 |
| | Test 2 | 60.1 |
| | Average | 60.0 |

The compositions utilized in the above samples were the following:

| Component | Concentration (% by weight) Sample A | Samples B & C |
|---|---|---|
| Water | 84.92 | 64.92 |
| Protein Component (Samples B and C only) (Product of fermentation of saccharomyces cerevisiae, without additional processing) | 0 | 20.0 |
| Inorganic salts (e.g., diammonium phosphate, ammonium sulfate, magnesium sulfate, zinc sulfate, calcium chloride) | 0.31 | 0.31 |
| Neodol ™ 25-7 Non-ionic surfactant) | 7.5 | 7.5 |
| Steol ™ CS 460 (Anionic surfactant) | 1.5 | 1.5 |
| Propylene glycol | 5.27 | 5.27 |
| Methyl paraben | 0.15 | 0.15 |
| Propyl paraben | 0.05 | 0.05 |
| Sodium benzoate | 0.15 | 0.15 |
| BHA | 0.02 | 0.02 |
| BHT | 0.02 | 0.02 |
| Ascorbic acid | 0.11 | 0.11 |
| | 100.00 | 100.00 |

As the foregoing results demonstrated, the addition of the protein component to Samples B and C caused up to a seven-fold downward shift in the CMC value for the surfactant-containing composition. In effect, the protein component increases the surface-active properties of the surfactants contained in the composition.

The downward shift in CMC value obtained by incorporating the protein component in a surfactant-containing composition has substantial utility for use in detergent compositions such as those described herein. In particular, the downward shift of CMC value for a given detersive surfactant or surfactant package in the presence of the protein component means that the surfactant(s) demonstrate an improved, increased, or enhanced level of surface-active properties. Thus, for a given detergent composition, the incorporation of the protein component in the composition makes it possible to obtain a greater level of surface-activity from the surfactants contained in the composition than would be obtained from the unmodified detergent composition. Alternatively, it would be possible to reduce the level of surfactant(s) contained in the detergent composition without sacrificing the level of surface-activity of the composition, or its cleaning ability.

For example, a conventional premium liquid laundry detergent formulation includes about 25% to about 40% by weight of surfactants. One such formulation, having 36% surfactants by weight, is reproduced below:

Premium Liquid Laundry Detergent Formulation

| Ingredients | % Wt | Function | Trade Name |
|---|---|---|---|
| Water | 53.36 | | |
| Boric acid | 1.10 | Enzyme stabilizer | |
| Sodium gluconate | 0.70 | Enzyme stabilizer | |
| Propylene glycol | 3.00 | Enzyme stabilizer | |
| EtOH 3A | 3.00 | Hydrotrope | |
| AG (50%) | 5.80 | Surfactant | Glucopon 625 UP |
| AE | 5.20 | Surfactant | Neodol 25-7 |
| FAES | 25.00 | Surfactant | Texapon N-70 |
| Optical brightener | 0.14 | UV whitening agent | |
| Sodium hydroxide, 50% | 0.50 | Neutralizer | |
| Monoethanolamine | 0.50 | Buffer | |
| Protease | 0.75 | Enzyme | Savinase 16.0L |
| Amylase | 0.95 | Enzyme | Termylase 300L |
| Preservative/ optical brightener | as needed | | |

(T. Morris, S. Gross, M. Hansberry, "Formulating Liquid Detergents for Multiple Enzyme Stability," Happi, January 2004, pp. 92-98). By incorporating the protein component described herein in a formulation such as the liquid laundry detergent listed above, it is possible to reduce the surfactant levels by at least 40%, and up to about 75% or more, while retaining a comparable CMC value for the laundry detergent composition and without sacrificing the cleaning performance of the formulation. Similar results may be obtained by incorporating the protein component in other detergent compositions, including all of those described elsewhere herein.

Thus, in addition to the compositions described herein, there are also described methods for improving, enhancing, and/or increasing the surface-active properties of surfactants in surfactant-containing compositions, and methods for reducing the levels of surfactants required for surfactant-containing compositions such as the detergent compositions described herein. In all of these methods, the beneficial results are obtained by the inclusion of a suitable protein component in the detergent composition. The resulting compositions will have CMC values and cleaning efficiency that are comparable to, or better than, the unmodified compositions.

Conversion of Grease to Surface-Active Material

Experiments were performed in which it was observed that the protein component, when used in combination with one or more surfactants, had the effect of converting greasy waste contaminants to surface active materials. In the experiments, a composition including surfactants and a protein component was added to diluted waste activated sludge (WAS), followed by observation of the volume of a bacon grease droplet in the composition. Interfacial tension reduction was confirmed to be by the creation of surfactant-like (interfacially active) materials, by checking the critical micelle concentration of the retains and noting that the critical micelle concentration was, in fact, reduced after exposure of the solution to the bacon grease.

In the following experiments, a small droplet of grease was formed on the end of a capillary tip within a bulk phase of the sample aqueous solution being studied. Measurements of interfacial tension between the droplet and the aqueous phase and of droplet volume were made as a function of elapsed time by optical pendant drop interfacial analysis using a Kruss Drop Shape Analysis System.

Trial 1: Grease Droplet in Aqueous Solutions

In a first experiment, a 5.0 microliter droplet of bacon grease was placed in a 5.0 milliliter aqueous solution and allowed to reach equilibriums for interfacial tension and droplet volume. In a first case, the aqueous solution was pure water. In a second, the aqueous solution contained 10 ppm of the Sample A formulation (surfactant-containing composition with no protein component). In a third, the aqueous solution contained 10 ppm of the Sample B formulation (surfactant-containing composition with protein component). The results are as follows.

Effect of Aqueous Solutions at 5.0 ml on a 5.0 microliter Bacon Grease Droplet

| Aqueous Solution | Initial Interfacial Tension with Bacon Grease (mN/m) | Equilibrium Interfacial Tension with Bacon Grease (mN/m) | Time Elapsed for Intervacial Tension Equilibration (minutes) | Equilibrium Grease Drop Volume (ul) | Time Elapsed for Volume Equilibration (minutes) |
|---|---|---|---|---|---|
| Sample B (10 ppm) | 15.80 | 7.06 | 1300 | 4.44 | 1300 |
| Sample A (10 ppm) | 18.20 | 17.35 | 30 | 4.92 | 500 |
| Pure water | 25.34 | 25.32 | NA | 5.00 | NA |

Effect of 5.0 microliter Bacon Grease Droplet on 5.0 ml Aqueous Solutions

| Aqueous Solution | Initial Surface Tension (mN/m) | Surface Tension After Grease Exposure (mN/m) | CMC No Grease Exposure (ppm) | CMC Found Starting with Grease Exposed Retain (ppm) |
|---|---|---|---|---|
| Sample B (10 ppm) | 64.12 | 39.01 | 75 | 35 |
| Sample A (10 ppm) | 71.60 | 71.57 | 442 | 442 |
| Pure Water | 72.50 | 72.48 | NA | NA |

Several conclusions were drawn from the above data. First, it was noted that pure water had no effect on the bacon grease, nor did the bacon grease have any effect on the pure water.

An additional conclusion drawn from the above data was that, with the surfactant package alone (Sample A, without the protein component), about 1.6% of the bacon grease volume (0.08 ul of 5.0 ul) is lost into the aqueous phase. However, it was concluded that this effect was due to emulsification of hydrophobic grease by the surfactants involved, and that it did not result in any significant increase in the amount of surfactant-like material available in the aqueous phase. This conclusion was based on three of the parameters listed above. First, the surface tension of the retain, after bacon grease exposure, was not significantly lower than the surface tension of the same aqueous solution before bacon grease exposure (as it would be if surface-active materials were added to the aqueous phase). Second, the CMC for the additives in the aqueous phase was unaffected by bacon grease exposure (it would be expected to decrease if significant amounts of new surface-active materials were created due to exposure to the grease). Third, the interfacial tension decay of the surfactant-only sample (Sample A) lasted about 30 minutes, whereas the loss of grease droplet volume in the Sample A solution lasted about 500 minutes, during which time the interfacial tension was already equilibrated. If the grease volume going into the aqueous phase was providing extra soluble surfactants to the aqueous phase, the interfacial tension would have been expected to continue to decay during the loss of grease droplet volume. This would be expected unless the interface between the grease droplet and the water was saturated with surfactant, so that added soluble surfactant to the aqueous phase could not go to that interface. However, at an interfacial tension of 17.35 mN/m, it is not possible that the interface was saturated with surfactant. Therefore, the emulsification of hydrophobic grease is the only reasonable explanation for the 1.6% grease lost in the Sample A data above.

Yet another conclusion drawn from the above data is that, in the Sample B case, which includes a surfactant-containing composition including a protein component, the much longer term and more substantial interfacial tension and grease droplet volume decay suggest that new interfacial active species are being generated by breakdown of the grease. This is shown, for example, by the much lower surface tensions determined for the retain solutions following grease drop exposure as well as the much lower CMC found when further concentrating the same retains. For example, by mass balance, it was known that 0.56 ul of the grease (11.2% of the original grease drop volume) passed into the 5.0 ml aqueous solution containing 10 ppm of Sample B after 24 hours. This represents a 112 ppm concentration of former grease materials in the aqueous phase. The CMC of the aqueous phase was then found to be 35 ppm, as opposed to 75 ppm for the aqueous Sample B composition alone. Thus, the CMC decreases by 40 ppm due to the presence of 112 ppm of former grease materials being taken into the water phase. Stated in other terms, 40/112, or 35.7% of the 11.2% of the grease drop materials lost from the grease droplet became surfactant-like, interfacially active species with the cleaning power of the order of the cleaning power of the Sample B formulation. This calculates as 4% of the grease being made into materials capable of cleaning more grease, as opposed to 0% in either the case of pure water alone, or in the case of the surfactant package only (Sample A) Finally, in the Sample B case, the interfacial tension decay and the grease drop volume decay followed the same time dependence, and the interfacial tension decay ceased at about 7.06 mN/m. These data indicate that the conversion of grease reaction had ceased after about 1300 minutes without the interface between the grease and the solution being saturated, which would happen at a lower interfacial tension.

Trial 2: Grease Droplet in Waste Activated Sludge

In a second experiment, a 5.0 microliter droplet of bacon grease was placed in a 5.0 milliliter in a 1:10 diluted aqueous mixture of waste activated sludge (WAS) and allowed to reach equilibriums for interfacial tension and droplet volume. In a first case, the aqueous solution contained only WAS. In a second, the aqueous solution also contained 10 ppm of the Sample B formulation (surfactant-containing composition with protein component). The results are as follows.

Effect of Aqueous Solutions at 5.0 ml on a 5.0 microliter Bacon Grease Droplet

| Diluted 1:10 WAS Aqueous Solution | Initial Interfacial Tension with Bacon Grease (mN/m) | Equilibrium Interfacial Tension with Bacon Grease (mN/m) | Time Elapsed for Intervacial Tension Equilibration (minutes) | Equilibrium Grease Drop Volume (ul) | Time Elapsed for Volume Equilibration (minutes) |
|---|---|---|---|---|---|
| Diluted WAS | 23.20 | 20.12 | g.t. 2880 | 4.79 | g.t. 2880 |
| Sample B (10 ppm) | 14.50 | 3.50 | 2500 | 3.57 | g.t. 2880 |

Effect of 5.0 microliter Bacon Grease Droplet on 5.0 ml Aqueous Solutions

| Diluted 1:10 WAS Aqueous Solution | Initial Surface Tension (mN/m) | Surface Tension After Grease Exposure (mN/m) | CMC No Grease Exposure (ppm) | CMC Found Starting with Grease Exposed Retain (ppm) |
|---|---|---|---|---|
| Diluted WAS | 66.81 | 57.07 | NA | NA |
| Sample B (10 ppm) | 60.13 | 25.72 | 68 | 4 |

Again, several conclusions were drawn from the above data. First, in both systems, it is apparent that grease is converted to interfacially active materials. However, the conversion of grease to interfacially active materials was much more substantial with the 10 ppm of Sample B present in the diluted WAS, relative to the diluted WAS alone. Further, the conversion of grease to interfacially active materials by the Sample B formulation was much more substantial in the diluted WAS than it was in pure water. Still further, sufficient grease conversion takes place in the Sample B case to saturate the aqueous phase/grease droplet interface, at an interfacial tension of about 3.50 mN/m, while the conversion reaction continued to add more interfacially active species to the bulk of the 10 ppm Sample B phase.

Turning to the data, the diluted WAS was found to have a surface tension of 66.81 mN/m, before exposure to the bacon grease, which is below that of pure water (72.5 mN/m). This indicated that the diluted WAS contained some surface active species on its own. Those surface active species were also found to be interfacially active—e.g., the initial interfacial tension between the diluted WAS and the bacon grease was found to be 23.20 mN/m, below that of the interfacial tension between pure water and bacon grease (25.34 mN/m).

Duplicate 48 hour interfacial tension experiments were run with the diluted WAS against 5.0 ul grease drops, using 5.0 ml of diluted WAS for each experiment. Interfacial tension decay was observed in both trials, as compared to a complete absence of interfacial decay observed in the pure water case. The decay was from 23.50 mN/m to 20.12 mN/m. In addition, loss of grease volumes was observed, from 5.0 ul to 4.79 ul. Accordingly, about 4.2% of the grease was lost to the aqueous phase, making the converted grease material concentration in the aqueous phase about 42 ppm, at 2880 minutes. The time frame for equilibration was roughly the same for both interfacial tension and for volume decay. Also, the equilibration times were too long to be caused by simple pre-existing surfactant equilibration at the interface. Thus, it was presumed that a reaction mechanism was at work, and that creation of interfacially active species from the grease was occurring.

The retains contained additional interfacially active material. Thus, the WAS itself was converting grease to interfacially active material. This is apparent not only from the time dependent data above, but also from the fact that the retains show surface tensions which average 57.07 mN/m—down from 66.81 mN/m before grease exposure. It was presumed, however, that insufficient amounts of interfacially active material were created to determine a CMC value for those materials alone.

Turning to the Sample B trials, the interfacial tension decay was from an initial value of 14.50 mN/m—a value lower than the initial interfacial tension for 10 ppm of Sample B in pure water, due to the interfacially active materials initially present in the WAS—to an equilibrium value of 3.5 mN/m in 2500 minutes. The fact that the grease volume loss continued out beyond the 2880 minute elapsed time period was due to the interface becoming saturated with the interfacially active materials formed in the 2500 minute time frame. As further support for this conclusion, after 48 hours of grease exposure the surface tension for the retain solutions were 25.72 mN/m. This is such a low surface tension that the solution was clearly beyond its CMC. Thus, at that point, one would expect the grease drop interface to be saturated with interfacially active materials.

The initial surface tension for the 10 ppm Sample B formulation in diluted WAS was 60.13 mN/m, which was lower than the value in pure water (64.12 mN/m, as above). This was due to the interfacially active materials initially present in the WAS. The 25.72 mN/m average retain surface tension was, however, much lower than the 39.01 mN/m average retain surface tension from the pure water trials.

The 10 ppm Sample B retains contained so much surfactant added to it from the grease breakdown that its concentration was above the CMC. Therefore, the retains CMC determination was made by diluting the retains with WAS. The results indicated a CMC of only 4 ppm in the presence of the surfactant-materials created from the breakdown of the grease. This value may be compared to the CMC for the 10 ppm Sample B formula in WAS with no grease exposure—68 ppm.

Thus, a mass balance was performed based upon the grease volume lost. The volume decrease from the grease droplet was 1.43 ul (5.0 ul minus 3.57 ul) in 2880 minutes, which grease volume was added to the WAS phase retains. This amounted to 28.6% of the grease, or 286 ppm. The CMC decrease, relative to the 10 ppm Sample B formulation, was 68-4=64 ppm. Stated otherwise, the CMC decreased by 64 ppm due to 286 ppm of the former grease materials being taken into the WAS phase. Thus, 64/286, or 22.4% of the 28.6% of the grease drop materials lost from the grease droplet become surfactant-like, interfacially active species, with the cleaning power of the order of the cleaning power of the Sample B formulation.

This calculates as 6.4% of the grease being made into materials capable of cleaning more grease (interfacially active species), for a 28.6% loss in the overall grease volume, for 10 ppm of the Sample B formulation in diluted WAS. These values are properly compared to 4.0% of the grease being made into interfacially active species for an 11.2% loss of overall grease volume for the 10 ppm of Sample B formulation in pure water. The diluted WAS alone showed a 4.2% loss of overall grease volume, with an undetermined amount of interfacially active species created. Pure water caused no grease loss (0%), and no interfacially active species development. The surfactant package alone (Sample A), caused a 1.6% grease loss, but no development of interfacially active materials.

The values for decrease in grease volume (i.e., % of a 5.0 ul drop lost due to exposure to 5 ml of the "cleaning" solution) are significant in terms of grease removal. In addition, the values for conversion of the grease into interfacially active materials capable of emulsifying grease are also significant, as they represent an autocatalytic grease removal process. These values are presented in the table below.

Effect of Various Solutions at 5.0 ml on a 5.0 ul Grease Drop

| Aqueous Solution | Grease Lost to Aqueous Phase | Grease Converted to Interfacially Active Materials |
|---|---|---|
| Pure Water | 0% | 0% |
| Sample A (10 ppm) in Pure Water | 1.5% | 0% |
| Sample B (10 ppm) in Pure Water | 11.2% | 4.0% |
| Diluted (1:10) WAS | 4.2% | NA |
| Sample B (10 ppm) in Diluted (1:10) WAS | 28.6% | 6.4% |

Effects on Contaminants

Detergent compositions that include the protein component have been shown to reduce fats, oils, and greases (FOG) in aqueous solutions at levels greater than those attributable solely to the surfactants contained in those detergent compositions. Fats, oils, and greases are components of biological oxygen demand (BOD) and total suspended solids (TSS), two frequently-used measures of wastewater contaminant levels. As a result, the detergent compositions of the present invention, including the protein component, have the advantageous benefit of reducing BOD and TSS in wastewater. Thus, incorporation of these detergents into aqueous waste streams, such as institutional, commercial, industrial, or municipal waste treatment facilities, will achieve beneficial decreases in contaminant levels, namely, BOD and TSS. In addition, the detergents may advantageously be used in waste transportation lines, such as sewer lines. In such cases, effective treatment of the waste to obtain significant decreases in FOG, BOD, and TSS may occur while waste is being transported, and not only within the boundaries of the waste treatment facility itself. In effect, the transportation lines become part of the waste treatment facility and cause treatment to occur while the waste material is being transported to the primary facility.

All patents, patent applications, and literature references cited in this specification are hereby incorporated by reference in their entirety.

Thus, the compounds, systems and methods of the present invention provide many benefits over the prior art. While the above description contains many specificities, these should not be construed as limitations on the scope of the invention, but rather as an exemplification of the preferred embodiments thereof. Many other variations are possible.

Accordingly, the scope of the present invention should be determined not by the embodiments illustrated above, but by the appended claims and their legal equivalents.

The invention claimed is:

1. A liquid detergent, comprising:

a detersive surfactant package of one or more surfactants;

adjunct detergent ingredients;

and a protein component comprising a mixture of multiple intracellular proteins, at least a portion of the mixture including yeast polypeptides obtained from fermenting yeast cells and yeast heat shock proteins resulting from subjecting a mixture obtained from the yeast fermentation to stress, the protein component having a concentration sufficient to substantially increase the surface activity of the one or more surfactants relative to the surface activity of the one or more surfactants in the absence of the protein component.

2. The liquid detergent of claim 1, wherein the protein component causes a substantial reduction in the critical micelle concentration (CMC) of the liquid detergent composition relative to the CMC of the liquid detergent composition in the absence of the protein component.

3. The liquid detergent of claim 2, wherein the protein component causes the critical micelle concentration (CMC) of the liquid detergent composition to be lower than the CMC of a liquid detergent composition comprising the detersive surfactant package having a total concentration by weight of from about 25% by weight to about 40% by weight but having no protein component.

4. The liquid detergent of claim 1, wherein said detersive surfactant further comprises a nonionic surfactant or an anionic surfactant.

5. The liquid detergent of claim 1, wherein said detersive surfactant further comprises an anionic surfactant.

6. The liquid detergent of claim 1, wherein said detersive surfactant further comprises at least one anionic surfactant and at least one nonionic surfactant.

7. The liquid detergent of claim 1, wherein said adjunct detergent ingredients comprise a neutralizer.

8. The liquid detergent of claim 7, wherein said neutralizer comprises one or more of monoethanolamine (MEA), diethanolamine (DEA), or triethanolamine (TEA).

9. The liquid detergent of claim 1, wherein said adjunct detergent ingredients comprise a hydrotropic agent.

10. The liquid detergent of claim 9, wherein said hydrotropic agent comprises ethanol.

11. The liquid detergent of claim 1, wherein said adjunct detergent ingredients comprise a protein stabilizer.

12. The liquid detergent of claim 11, wherein said protein stabilizer comprises one or more of propylene glycol or borax.

13. The liquid detergent of claim 1, wherein the mixture of multiple intracellular proteins comprises the product of a fermentation of a plurality of yeast cells in the presence of a nutrient source.

14. The liquid detergent of claim 1, wherein the fermenting yeast cells comprises *saccharomyces cerevisiae.*

15. The liquid detergent of claim 13, wherein said plurality of yeast cells comprise one or more of *saccharomyces cerevisiae, kluyveromyces marxianus, kluyveromyces lactis, candida utilis, zygosaccharomyces, pichia*, or *hansanula.*

16. The liquid detergent of claim 13, wherein the nutrient source comprises a sugar.

17. The liquid detergent of claim 16, wherein the nutrient source further comprises one or more of diastatic malt, diammonium phosphate, magnesium sulfate, ammonium sulfate zinc sulfate, and ammonia.

18. The liquid detergent of claim 1, wherein the protein component causes a substantial reduction in the surface tension of the liquid detergent composition relative to the surface tension of the liquid detergent composition in the absence of the protein.

19. The liquid detergent of claim 1, wherein the protein component causes a substantial reduction in the interfacial tension of the liquid detergent composition relative to the interfacial tension of the liquid detergent composition in the absence of the protein.

20. The liquid detergent of claim 1, wherein the detersive surfactant package comprises a total surfactant concentration of from about 6% by weight to about 24% by weight.

21. The liquid detergent of claim 1, wherein the stress is heat stress.

* * * * *